US005195812A

United States Patent [19]

Eickhof

[11] Patent Number: 5,195,812

[45] Date of Patent: Mar. 23, 1993

[54] COLUMBARIUM

[75] Inventor: John K. Eickhof, R.R. 2, Box 17, Crookston, Minn. 56716

[73] Assignee: Paul Eickhof, Erskine, Minn.

[21] Appl. No.: 661,687

[22] Filed: Feb. 27, 1991

[51] Int. Cl.[5] ..... A47B 47/00

[52] U.S. Cl. ..... 312/257.1; 52/136

[58] Field of Search ..... 312/111, 257.1, 263, 312/264, 265, 265.6; 52/128, 133, 134, 136, 137; 211/189

[56] References Cited

U.S. PATENT DOCUMENTS

| | | | |
|---|---|---|---|
| 1,300,173 | 4/1919 | Kennedy | 52/136 |
| 2,814,942 | 12/1957 | Sinner et al. . | |
| 3,655,065 | 4/1972 | Yellin | 312/257.1 X |
| 3,754,805 | 8/1973 | Pangburn et al. | 52/136 X |
| 3,879,096 | 4/1975 | Blodee | 312/257.1 X |
| 3,897,663 | 8/1975 | Gaul . | |
| 4,068,425 | 1/1978 | Czorniak | 52/136 |
| 4,073,100 | 2/1978 | DiGiovanni, Jr. | 52/136 X |
| 4,614,066 | 9/1986 | Koppenberg . | |
| 4,644,711 | 2/1987 | Eickhof . | |

*Primary Examiner*—Kenneth J. Dorner
*Assistant Examiner*—Brian K. Green
*Attorney, Agent, or Firm*—Merchant, Gould, Smith, Edell, Welter & Schmidt

[57] ABSTRACT

A columbarium (20) is constructed with a framework (22) having risers (24) extending vertically and having brackets (30) mounted thereon. Tie rods (26) extend horizontally through the brackets to connect the risers (24). Shelves (28) rest on the brackets (30) and space the risers and also hide the tie rods for improved appearance. A backing (46) covers the rear of the columbarium and front covers (42) hide each niche. Decorative stone facing can then be attached to the front of the shelves (28). The flexibility and the height of the risers and width of the tie rods provides for a variety of sizes. In addition, the columbarium may be constructed using modules (70) which can be transported and then later joined together with additional tie rods (27) extending between the brackets (30).

20 Claims, 4 Drawing Sheets

COLUMBARIUM

BACKGROUND OF THE INVENTION

1. Field of the Invention

The present invention relates to a columbarium for storing urns and the like and a method for making the same.

2. Description of the Prior Art

Columbariums provide long term storage for urns holding cremated human remains. Columbariums generally have a number of small holding chambers, also known as niches, which each hold an urn and sometimes more than one urn. The niches are generally arranged in banks and with stone facing added to create a dignified appearance.

Columbariums are usually exposed to the elements and must be able to withstand time and weather for hundreds of years. Therefore, the construction must be sturdy and weather-tight.

Heretofore, columbariums have been constructed using poured concrete techniques, as is commonly used for crypts. Poured concrete columbariums have an exceptionally heavy waffle like configuration. Using this technique, concrete is poured into a mold which forms the back, shelves and sides of the niches. Covers are then attached to seal the niches and facing is added for improved appearance. Due to the width required for pouring the concrete, the riser portions and shelves dividing the niches must be somewhat thicker than would be required for other materials, adding extra weight. Since caskets are being supported in crypts, the heavy poured concrete construction is needed. However, only urns and stone facing are supported in columbariums, so that the heavy-duty framework of poured concrete columbariums is not required. Due to the weight and size of the structure, it is difficult and costly to transport a poured concrete columbarium.

Because of molds required, the niches must be shaped with a slight slope to ease separation, so that the columbarium and mold slide easily apart. Since molds must be made to construct each size of a poured concrete columbarium, it is difficult to make a new size columbarium without making a new mold. The cost of molds becomes a major expense which drives up the cost of a columbarium.

With relatively thick walls, joining modules of niches together end to end requires an extra stone facing panel to cover the added width at the joint. The addition typically has a different width than rest of the facing covering each niche, thereby ruining symmetry of the otherwise equally arranged stone facing of the niches.

It can be seen then, that an improved columbarium is needed which is lightweight, easily adapted to changing size, weather-tight, durable and easy to assemble. The present invention addresses these and other problems associated with columbariums.

SUMMARY OF THE INVENTION

The present invention is directed to a columbarium for storing cremated remains According to the present invention, the columbarium utilizes a lightweight framework rather than poured concrete for construction. The framework uses planar risers having brackets mounted thereon at the approximate height of each shelf of a niche. The brackets are used to support lightweight shelving which forms the top and bottom of the niches. The shelving also provides spacing and bracing to the overall framework.

The risers are connected by tie rods extending horizontally through the risers and the brackets attached thereto. When tightened down, the risers and tie rods provide the required rigidity to the overall framework. The risers and tie rods thus form a lightweight frame connected horizontally and vertically. The shelves then are set over the tie rods onto the brackets so that the tie rods and brackets are hidden during usage.

Each shelf has a front and rear lip so that backing or facing and any accompanying hardware may be attached. The rear of the niche is covered with a backing which covers a number of niches to seal the rear of the niche compartment. The niches have an inner cover which provides for a sealed compartment for storing the urn or other holding vessel. The front of the shelf further includes hardware for attaching a decorative stone facing or other material to provide a dignified outer appearance. It can be appreciated that the columbarium may be placed so as to be exposed to the elements, thereby requiring that the materials and hardware be weather-tight as the columbarium must endure long term usage.

The tie rod and riser framework construction provides for assembling columbariums having a variety of sizes with a varied number of niches extending both vertically and horizontally. In addition, the construction provides for building modules of niches which may be later joined to form an extended columbarium. The brackets provide for extending tie rods between the modules and placement of filler shelves between the modules which are the same size as the module niches. This provides for even spacing of the niche compartments across the columbarium. The symmetry is thereby preserved for the decorative facing which is later attached.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENTS

Figure 1:
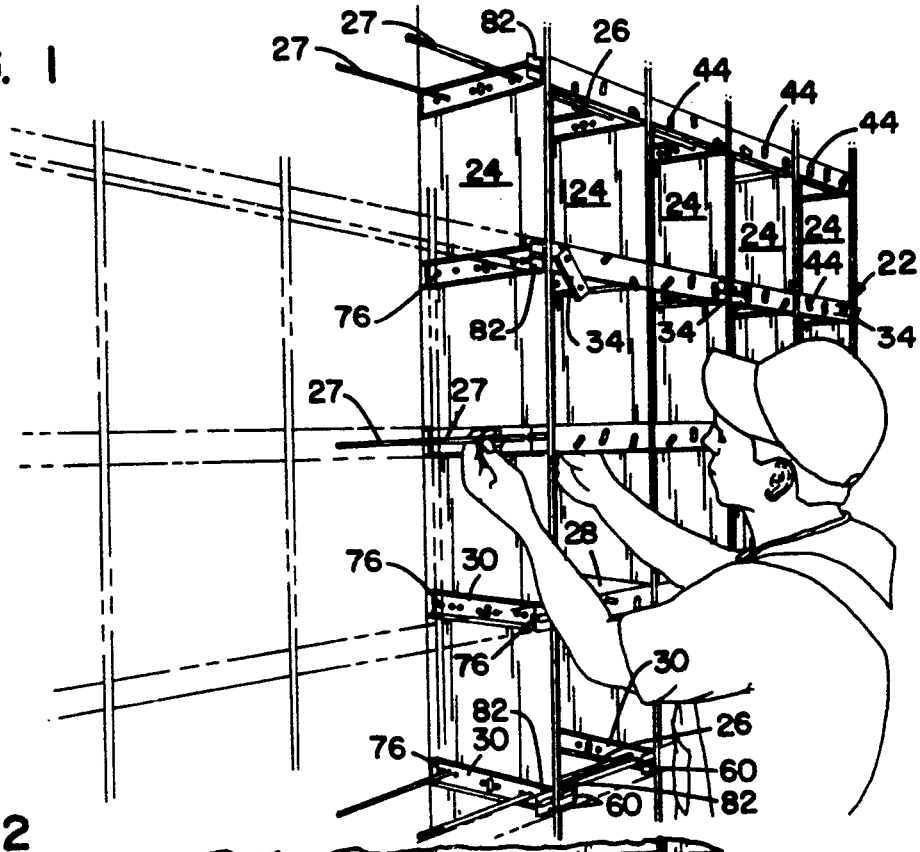
FIG. 1 shows a perspective view of partially completed framework of a columbarium according to the principles of the present invention.
Figure 7:
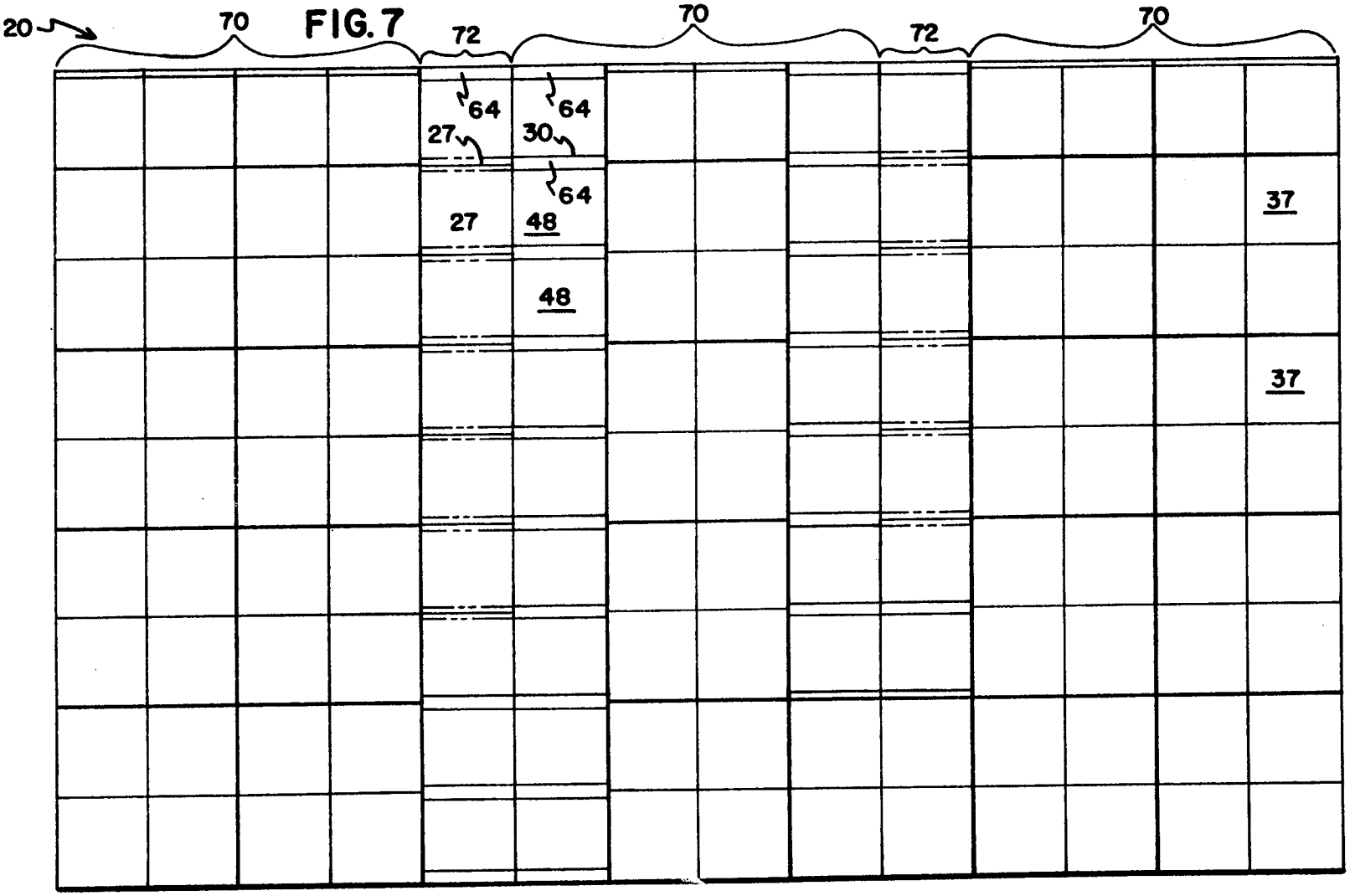

Referring now to the drawings and in particular to FIG. 7, there is shown a columbarium 20. The columbarium forms compartments, commonly called niches, which hold one or more urns or other vessels. As shown in FIG. 1, the columbarium 20 is erected on a framework 22 having a plurality of planar risers 24 which also form the sides of each niche.

Figure 2:
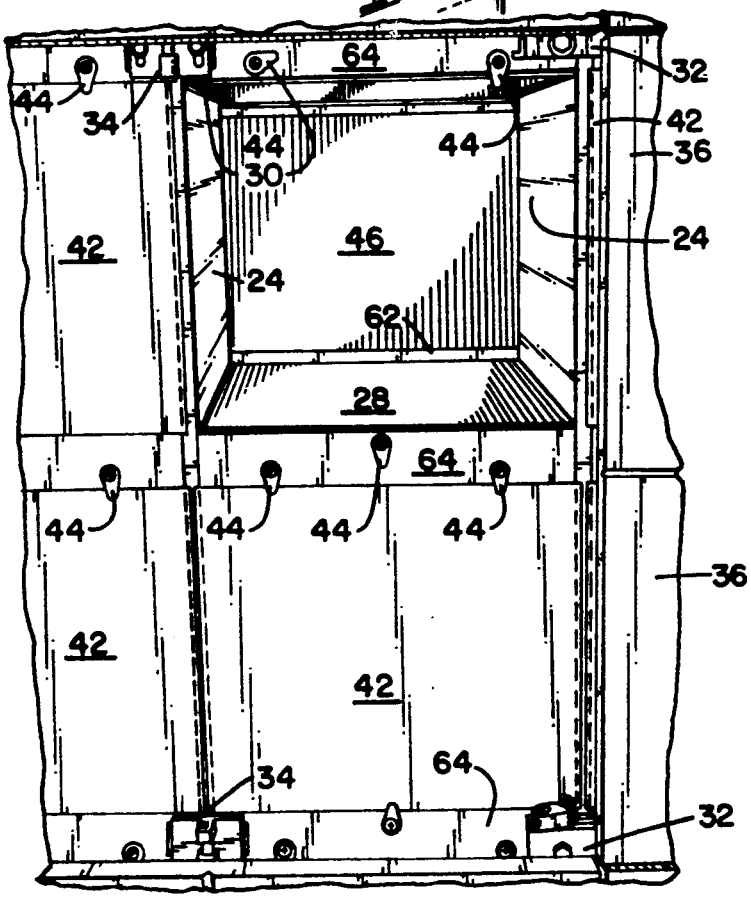
FIG. 2 shows a front perspective view of a columbarium niche.
Figure 3:
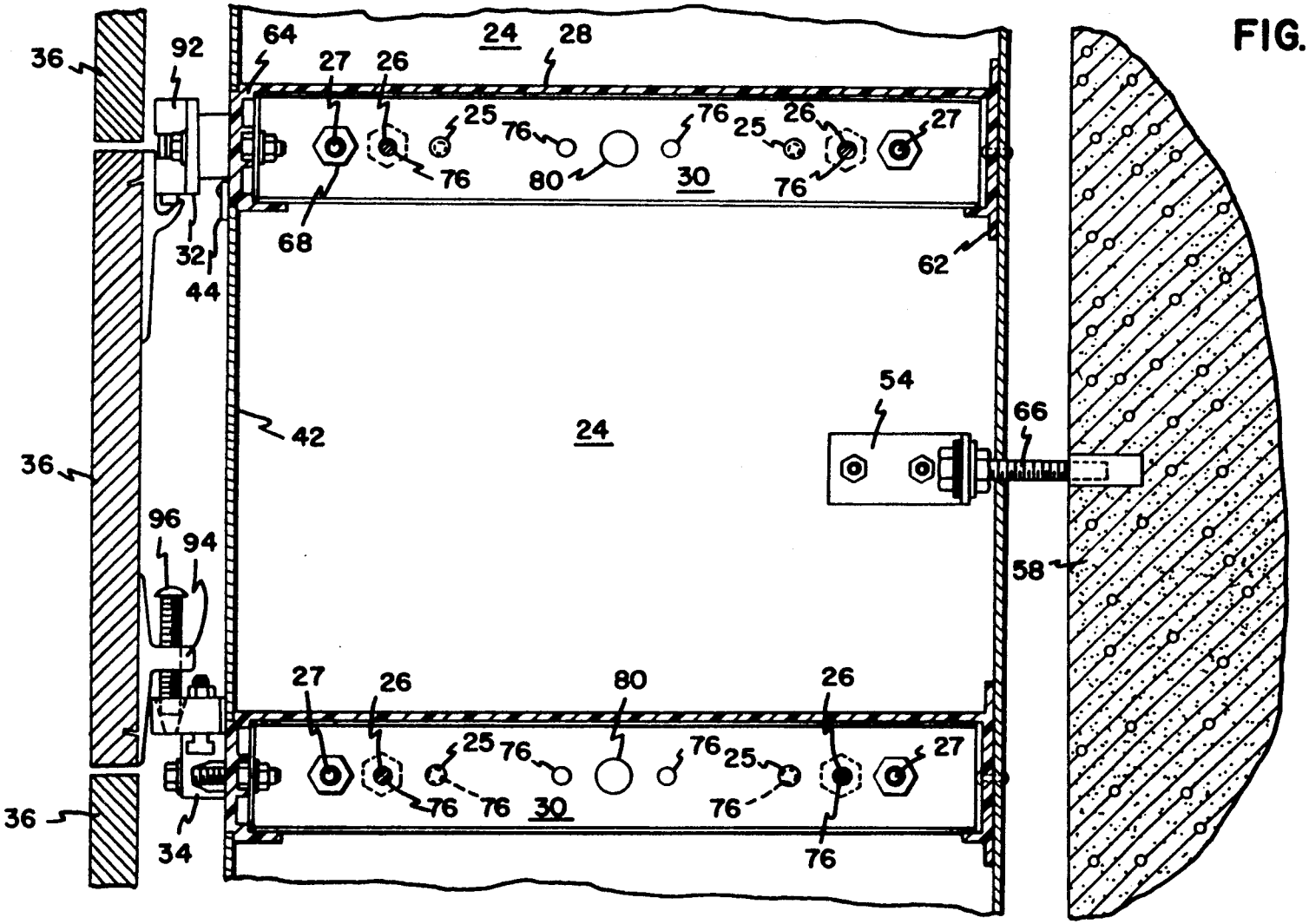
FIG. 3 shows a side sectional view through a niche in a filler column with decorative stone facing attached.
Figure 4:
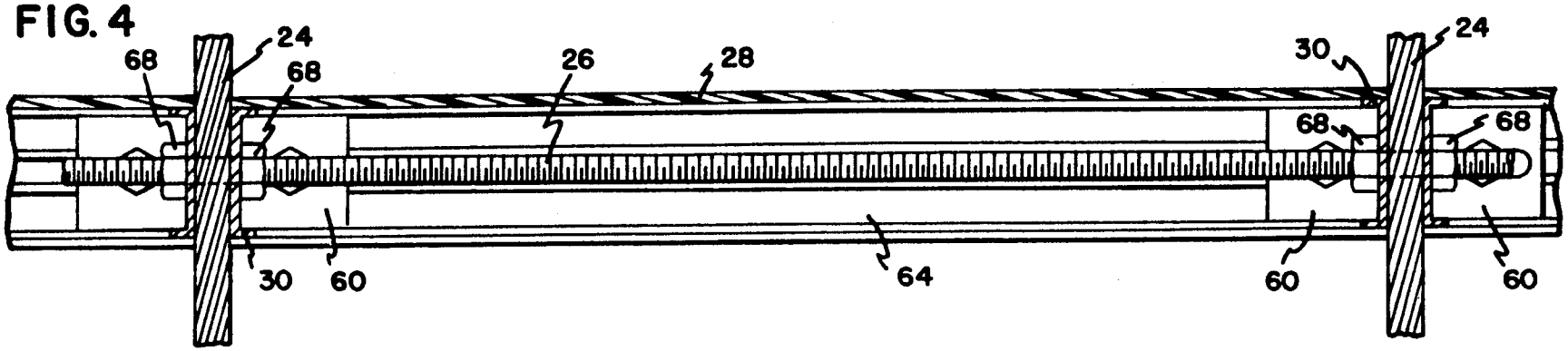
FIG. 4 shows a front sectional view of a shelf and tie rod arrangement.

In the preferred embodiment, the risers 24 are made from cement fiberboard which is strong, lightweight and weather resistant. The risers 24 are connected horizontally by tie rods 26 extending through the risers spaced by a distance equal to the height of each niche. The tie rods 26 also extend through mounting brackets 30 attached to each side of the risers 24 with rivets 25. Each pair of opposing brackets 30 supports a shelf 28. In the preferred embodiment, each shelf 28 has a front lip portion 64 and rear lip portion 62 extending down and around the brackets 30, as shown in FIG. 3. In addition, the front lip 64 hides the brackets 30 and the tie rods 26 for improved appearance, as shown in FIG. 2. The brackets 30 provide bracing to the shelves 28 which have a profile which fits around the outline of the brackets 30, as shown in FIG. 4. In the preferred embodiment, the shelves 28 are made from extruded plastic which is lightweight, weather resistant and easily manufactured. The tie rods 26, brackets 30 and other metal framework elements are preferably made of brass or stainless steel to prevent rust. The frame 22 rests on concrete block or another suitable base supporting the risers 24 and raising the lowermost shelves 28 off the ground.

As shown in FIG. 2, each niche is enclosed with a plastic cover 42 which is retained by clips 44 mounting on the front lip 64 of the shelf 28 and a cement fiberboard backing 46, which is typically riveted to the rear lip 62, as shown in FIG. 2. The columbarium 20 is attached to a support structure 58, such as a wall or a second bank of niches. A right angle attachment bracket 54 bolts to the side of a riser 24. A bolt 66 extends from the right angle portion of bracket 60 through backing 46 and attaches into the support structure 58 to anchor the frame 22 next to the support structure 58.

As shown in FIG. 7, larger columbariums are assembled by joining modules 70 to create an extended bank of niches. In the preferred embodiment, each module 70 is four columns of niches wide, however other module sizes are possible depending on the requirements for transportation and the size of the columbarium 20. A column of filler shelves 72 is inserted between modules 70 with shortened tie rods 27 extending through the filler shelves 72 and the end risers 24 of adjacent modules 70 to connect the modules 70, as shown in FIG. 3. The shortened tie rods 27 extend through holes 76 in the brackets 30. With the tie rods 26 extending through the modules 70, there is formed a continuous horizontal support across the entire columbarium 20.

As shown in FIG. 3, the filler tie rods 27 are placed inside of the tie rods 26 in holes 76 extending across each module 70 in tying into the brackets 30. The tie rods 26 and 27 provide rigidity to the columbarium 20 while the risers 24 along with the brackets 30 bear the weight of the columbarium. The tie rods 26 can be left loose until final assembly, when nuts 68 at the ends of the modules 70 are tightened down for adjusting to fit into the allotted space. The filler column 72 has backing tiles 48 inserted into each niche resting against the downward and upward extending portions of the rear lip 62. In the preferred embodiment, the backing tiles 48 are made of the same cement fiberboard as the risers 24 and the backing panels 46, the backing panels 46 and the backing tiles 48 being typically one eighth inch thick.

The brackets 30 have a plurality of attachment holes 76 and 80, as best shown in FIG. 3 configured for a variety of attachment applications. An inner pair of holes 76 typically receive tie rods 26 for attachment to the risers 24. An outer pair of the holes 76 receive tie rods 27 for making connections for the filler column 72 between modules 70 of niches. The large center hole 80 and additional holes 76 are utilized for a variety of other connection applications including attaching hardware to the ends of the modules, such as is used for decorative facing on the ends. The risers 24 have holes drilled therethrough aligned with the holes used for the tie rods 26 and 27 and for other attachments as needed. A right angle portion 60 of the bracket 30 has a slot 82 which is used for attaching hardware for supporting facing along the front of the columbarium 20. Since shelves are not supported on the outer sides of the end risers 24, the end brackets do not include a right angle portion 60. The end brackets are extended approximately one half inch to add support to the risers.

Figure 5:
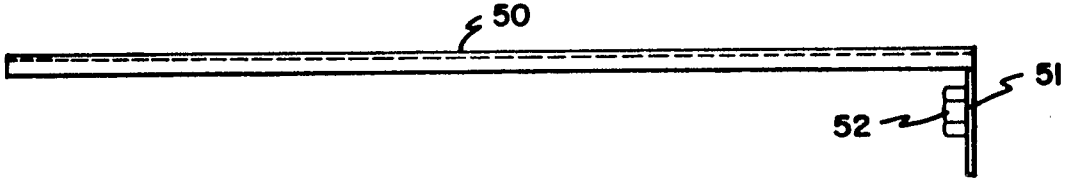
FIG. 5 shows a top view of a mounting bracket used at the bottommost shelf of the columbarium.

In FIG. 5, there is shown a bracket 50 adapted for attachment to the risers 24 at the very bottom. A right angle portion 51 of the bracket 50 includes a nut 52 welded to the bracket 50. Due to the lack of space between the lowest shelf 28 and the base, it is difficult to access a nut tightened onto a bolt, therefore the nut 52 is welded to the right angle portion 51 of the bracket 50 so that the nut 52 need not be retained while a bolt is inserted.

As shown in FIG. 3, the columbarium has a decorative stone facing, including shutters 36, which are hung on the columbarium and which are engraved for marking purposes. Shutters may come in varying sizes, such as singles, doubles, triples, quads and sextets covering different numbers of niches. In the embodiment shown in FIG. 7, for example, each shutter 37, covers four niches, commonly called a quad. The columbarium 20 may also include a capstone 35 across its top for improved appearance. The present invention provides for using various types of hardware for hanging shutters which attach to the frame 22 and which may be used for hanging the quads 37 as well as the single shutters 36. For example, fasteners such as that shown in U.S. Pat. No. 4,644,711 may be used with the present invention. As shown in FIGS. 2 and 3 in the preferred embodiment, the shutters 36 rest on hangers 34 at their lower edge and are held by retainers 32 along the upper edge. Typically, hangers 34 are placed at each lower corner and a single retainer 32 is placed at the center of the upper edge of the shutter 36 or 37. The shutters 36 have hanging members 92 and 94 mounted on the inward facing side and are hidden from view. Lower hanging member 94 includes bolt 96 which rests in the hanger 34 to support the shutter 36 along its lower edge. The bolts 96 can be turned for positioning the shutters 36. Upper hanging member 92 is engaged by the retainer 32. A tool (not shown) is inserted into the retainer 32 between shutters 36 to free the shutter 36 from the upper retainer 32. The shutter 36 then is resting on the lower hangers 34 and can be rotated forward and lifted off.

Figure 6:
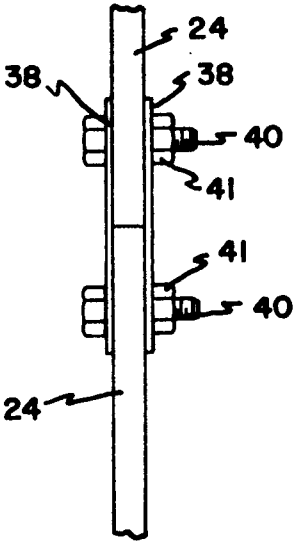
FIG. 6 shows a side view of a splice for connecting risers for extending the height of the columbarium; and, FIG. 7 shows a perspective view of plurality of modules of niches being connected to form an extended wall of niches, the wall having most of the stone facing attached.

Should additional height be required for a columbarium, the risers 24 may be spliced end to end as shown in FIG. 6. The risers 24 are spliced at approximately the midway point between shelves 28. Splicing plates 38 are attached to the ends of the risers with nuts 41 and bolts 40 or other suitable connectors. In this manner, the splicing hardware does not impinge on the shelves 38 or the brackets 30.

Assembly of the columbarium 20 is accomplished by building a framework 22 and attaching shelving and hardware to the frame 22. The brackets 30 are attached to the risers 24 and then have the tie rods 26 extended through the risers 24 and brackets 30 as shown in FIG. 3. The risers 24 and tie rods 26 form the frame 22 for supporting the columbarium 20. The backing panels 46 are then attached to form modules 70, or the framework 22 of an entire columbarium. The modules 70 are then set in place and attached with the shortened tie rods 27. The filler shelves 72 and backing tiles 48, hanging hardware 32 and 34, facing 36 or 37 and covers 42 are then attached to finish the columbarium 20. The assembly allows for construction of the modules 70 which are brought to the final site for setting in place.

The tie rods 26 provide sufficient flexibility to bend so that the bank of niches does not need to be straight. For example, the niches may be wedge-shaped providing for bending the columbarium 20 in a round or curved configuration, wherein the risers 24 are not placed parallel and the shelves 28 and back tiles 48 are shaped accordingly to fit the desired configuration. The risers 24 provide sufficient support and are flexible enough so that the diameter of the columbarium may be reduced to as little as eight feet. It can be appreciated that curved modules may be combined with straight modules for a variety of columbarium configurations.

The combination of materials for the various components and the overall construction provides for a lightweight framework 22 for a weather-tight columbarium 20. Horizontal support and rigidity is provided with the stainless steel tie rods 26. Vertical load bearing is provided by the cement fiberboard risers 24. The extruded plastic shelving 28 provides spacing and additional bracing when attached to the brackets 30 mounted on the risers 24. The use of lightweight materials throughout the framework 22, rather than poured concrete, lessens the load bearing requirements of the supporting components.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A shelving apparatus, having a cabinet with a plurality of substantially rectangular compartments, comprising:

a) riser means extending perpendicularly into a face of a cabinet;

b) shelving means for forming tops and bottoms of each of the compartments;

c) shelf supporting means attached to the riser means for supporting the shelving means wherein the shelf-supporting means include brackets and wherein the shelving means include molded shelf portions extending between the riser means and over and around each bracket;

d) horizontal rod means extending through each of the riser means perpendicular to the plane of each of the riser means and through the shelf supporting means for bracing the shelving apparatus; and e) backing means providing covering to a rear face of the apparatus.

2. An apparatus according to claim 1, further comprising cover means for covering a front face of each compartment, wherein the cover means removably attaches to the molded shelf portions.

3. An apparatus according to claim 1, further comprising facing means providing a decorative surface to a front face of the apparatus.

4. A shelving apparatus according to claim 1, wherein the riser means comprise cement fiberboard.

5. A shelving apparatus according to claim 1, further comprising shutter supporting means, wherein the shutter supporting means comprise a first member mounting to a shutter, and a second member mounting to the shelving apparatus, wherein the first member includes a bolt projecting therefrom and wherein the second member includes a bolt receiving portion, whereby the bolt rests on the bolt receiving portion and rests on the bolt receiving portion and rotatably adjusts to raise and lower the first member relative to the second member.

6. A shelving apparatus according to claim 1, further comprising decorative stone means for covering exposed portions of the shelving apparatus with decorative stone.

7. A columbarium forming a wall of compartments for storing urns, comprising:

a) means for supporting stone facing on the columbarium;

b) a plurality of planar risers extending substantially perpendicular to the plane of the wall of the columbarium;

c) horizontal tie rod supports extending along a longitudinal span of the columbarium through a plurality of the risers and connecting the plurality of risers to form a framework;

d) columns of shelves extending between adjacent risers, wherein each shelf rests over the horizontal supports, and a plurality of brackets attached to the planar risers for supporting the shelves, said plurality of brackets having a longitudinal axis which is perpendicular to a longitudinal axis of the horizontal tie rod supports;

e) rear wall means covering a rear face of the columbarium;

f) supporting wall attachment means for attaching the columbarium to a support structure.

8. A columbarium according to claim 7, wherein the shelves are comprises of extruded plastic.

9. A columbarium according to claim 7, wherein the mounting brackets are attached to each riser, wherein the horizontal supports extend through the mounting brackets and wherein the brackets include a front angled portion attached to the shelves.

10. A columbarium according to claim 9, wherein each of the shelves is configured for fitting around the mounting brackets.

11. A columbarium according to claim 7, wherein each of the shelves further comprises a front lip portion extending vertically for attaching the stone supporting means.

12. A columbarium according to claim 7, wherein the shelves are arranged in vertical columns extending between the risers.

13. A columbarium according to claim 12, wherein the columns of shelves are joined into modules comprising a plurality of columns and wherein the modules are joined to form an extended bank of shelves.

14. An urn storage apparatus, forming a multiplicity of connected niches, each niche storing one or more urns, comprising:

a) a plurality of planar risers forming sides of each said niche;

b) a plurality of shelves, each said niche having a shelf;

c) shelf supporting means attached to the risers for supporting the shelves, wherein the shelf-supporting means includes a pair of shelf support brackets attached on both sides of each shelf to the risers so that each shelf is supported at both sides by a shelf support bracket, and wherein the shelves fit around a front and rear portion of the shelf supporting means;

d) horizontal tie rod means extending through the risers and shelf support brackets for bracing the storage apparatus;

e) shutter supporting means for attaching facing to the storage apparatus; and, f) rear wall means for providing a rear covering for the storage apparatus.

15. A storage apparatus according to claim 14, wherein the risers are comprised of cement fiberboard.

16. A storage apparatus according to claim 14, wherein the shelves are comprised of extruded plastic.

17. A storage apparatus according to claim 14, wherein a plurality of niches are attached and formed in a module and wherein modules are attachable to form an extended bank of niches.

18. A storage apparatus according to claim 17, wherein the modules are attached to adjacent modules by extending filler tie rod means between adjacent modules and placing a column of filler shelves between the modules.

19. An urn storage apparatus according to claim 14, wherein the shutter supporting means comprise a first member mounting to a shutter, and a second member mounting to the urn storage apparatus, wherein the first member includes a bolt projecting therefrom and wherein the second member includes a bolt receiving portion, whereby the bolt rotatably adjusts to raise and lower the first member relative to the second member.

20. An urn storage apparatus, forming a multiplicity of connected niches, each niche storing one or more urns, comprising:

a) a plurality of planar risers forming sides of each niche;

b) a plurality of shelves, each niche having a shelf;

c) shelf supporting means attached to the risers, wherein the shelf supporting means includes shelf support brackets, and wherein the shelf support brackets are attached on both sides of each shelf to the risers so that each shelf is supported at both sides by a shelf support bracket;

d) horizontal tie rod means extending through the risers and shelf support brackets for bracing the storage apparatus;

e) shutter supporting means for attaching facing to the storage apparatus;

f) rear wall means for providing a rear covering for the storage apparatus; and, g) capstone means for covering a top portion of the storage apparatus.

* * * * *